US006483084B2

(12) United States Patent
Petri et al.

(10) Patent No.: US 6,483,084 B2
(45) Date of Patent: Nov. 19, 2002

(54) RADIANT HEATER

(75) Inventors: Heinz Petri, Bretten (DE); Eugen Wilde, Knittlingen (DE); Bernhard Belz, Waghaeusel (DE); Hans Mohr, Sulzfeld (DE); Ulrich Jenz, Oberderdingen (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 09/949,369

(22) Filed: Sep. 7, 2001

(65) Prior Publication Data

US 2002/0121510 A1 Sep. 5, 2002

(30) Foreign Application Priority Data

Sep. 7, 2000 (DE) ..... 200 15 496 U

(51) Int. Cl.[7] ..... H05B 3/68
(52) U.S. Cl. ..... 219/460.1; 219/461.1
(58) Field of Search ..... 219/448.19, 460.1, 219/461.1, 462.1, 463.1, 464.1

(56) References Cited

U.S. PATENT DOCUMENTS 4,845,340 A * 7/1989 Goessler et al. ..... 219/448.19
5,310,993 A * 5/1994 McWilliams et al. .. 219/448.19
5,489,764 A * 2/1996 Mannuss et al. ..... 219/448.19

FOREIGN PATENT DOCUMENTS

DE 35 36 981 A1 4/1987
DE 91 13 992.9 2/1992

* cited by examiner

*Primary Examiner*—Sang Paik
(74) *Attorney, Agent, or Firm*—Akerman Senterfitt

(57) ABSTRACT

According to an exemplary embodiment of the invention a radiant heater (11) for a glass ceramic cooking area (25) is created. The radiant heater comprises a carrier shell (12) carrying a flat insulator (14), on which is placed a heating means (16). A thermal relay (18) projects with its tube-like sensor (19) into the central area of the radiant heater (11) and the sensor can rest on an elevation (23) of the insulator (14). By means of a holder (45) the sensor (19) can be fixed to the carrier shell (12). The holder does not project over the underside of the carrier shell (12). In one embodiment the holder with barb-like ends reaches into an opening in the carrier shell and is fixed to locking edges of the carrier shell.

43 Claims, 4 Drawing Sheets

RADIANT HEATER

FIELD OF APPLICATION AND PRIOR ART

The invention relates to a radiant heater. The invention specifically relates to a radiant heater for placing beneath a cooking area, particularly a tempered glass or glass ceramic plate, having a carrier shell, which carries an insulator, on and/or in which is located a heater forming a heating zone, and with at least one elongated temperature sensor of a protective switch projecting over part of the heating zone and running between the latter and the cooking area, the sensor being retained by the insulator and fastening means reaching the carrier shell.

Such radiant heaters conventionally have a temperature sensor, whose outer tube is made from an insulating material, particularly quartz or quartz glass. It is either incorporated into the expansion system of the sensor, in which it forms a tube with a low expansion coefficient, in which is located a tension bar with a higher expansion coefficient, or it is shoved onto an expansion tube. This is necessary in order to ensure the necessary air gaps or leakage distances in the space between the heating resistors and the plate through which the temperature sensor passes. It must be borne in mind that glass ceramic plates become electrically conductive at the operating temperature, so that here the necessary insulation distances must be maintained.

A sensor fastening of this type is described by DE 35 36 981. As sensor fastenings are proposed spacers with respect to the glass ceramic plate and the insulator. The sensor can also be fastened in the insulator by nail clamps or the like.

DE 91 13 992 describes a sensor fastening, in which the retaining clips embrace the sensor and are guided by the insulator and carrier shell and behind the passage through said shell have a locking member preventing an extraction from the carrier shell. Inter alia such a sensor fastening ensures that the sensor does not strike against the glass ceramic plate, which could lead to the breakage of the latter. This can occur both during testing and during the transportation or installation of a cooking area.

PROBLEM AND SOLUTION

The problem of the invention is to provide a radiant heater of the aforementioned type in which a reliable sensor fastening is possible, whilst also bringing about an improvement to the fitting of both the sensor fastening and the radiant heater, together with the subsequent working of the finished radiant heater.

This problem is solved independently by the features of claim 1, claim 11, claim 21 and claim 31. Advantageous developments of the invention form the subject matter of the dependent claims and are described hereinafter. The essence of the invention is that the fastening means are at least partly shaped from the material of the carrier shell. On fastening temperatures sensors to radiant heaters using conventional fastening means generally openings or holes are e.g. punched out on the carrier shell and in them are then inserted and secured the fastening means. However, waste occurs with this process and said waste material can stick to the punching tool and make it dirty. As a result exact, clean punching is no longer possible. The punching tool must be cleaned or, if necessary, replaced which takes up a relatively large amount of time. The punched out openings or holes are provided with projecting lugs or nozzles which prevent an exact fixing of the fastening means. These disadvantages are obviated according to the invention in that the fastening means are essentially formed from the same material as the carrier shell. Thus, there is no waste and there are no prejudicial openings or lugs.

Sheet metal is preferably used as the carrier shell material. Sheet metal is heat resistant and has a relatively low weight. In spite of this its carrying capacity is so high that it is able to carry the insulator. It would also be possible to use other heat resistant materials, such as ceramics or the like.

The fastening means preferably comprise a holder for holding the sensor and an abutment for securing the holder. Compared with the holder portion extending through the insulator, the abutment advantageously has a different configuration. Thus, it is possible for the abutment to be inclined or to be substantially transversely directed. Thus, e.g. a holding leg of the holder can be bent at right angles behind the insulator in order to prevent extraction. The holder is preferably retained by engaging the abutment with its entire or a large surface against the underside of the insulator. This reduces or eliminates the risk of the fastening being torn out of the insulator.

In particularly preferred manner the abutment is shaped out of the carrier shell. The abutment can be formed from several lugs formed out of the carrier shell and to which the holder can be fixed. However, preferably the abutment is shaped in one piece from the carrier shell, e.g. by a punching process, where two mirror symmetrical notches are punched into the carrier shell and the material between the two notches can then be bent up as abutments.

Preferably a locking connection is located between the holder and the abutment. It can have an insertion bevel for inserting the holder and a locking edge for locking a barblike end of the holder. On sliding over the insertion bevel the holder, e.g. two holding legs, can be elastically bent upwards to a certain extent. On reaching the locking edge, its barblike end can engage below the locking edge and snap in. The abutment can have all conceivable cross-sectional shapes, e.g. an inverted V-shaped cross-section or a trapezoidal cross-section. However, it preferably has a substantially cap-shaped cross-section and a central portion of the abutment is arcuately directed towards the insulator and two lug-like legs of the abutment are bent away from the insulator. The arcuately constructed central portion can be supported on the underside of the insulator without damaging the latter, as could be the case with e.g. tapering central portions. To obtain a relatively large contact surface on the underside of the insulator, the central portion is preferably made wider than the two legs.

It is possible for the abutment to be formed in a bulge of the carrier shell directed towards the insulator, the carrier shell bulge projecting into an insulator bulge constructed in complimentary manner thereto. The two complimentary bulges on the carrier shell and insulator enable them to be stacked in one another.

The holder can have an elongated portion or long holding legs, which extend through the insulator up to the abutment. The holder or holding legs can preferably engage over or round in an at least partial manner said sensor and in this way position it, e.g. by pressing against the insulator.

The holder can be a clip with two legs and a U or O-shaped upper part for retaining the sensor. The upper part can extend or engage over the sensor and hold it in position, particularly by pressing against the insulator.

In an alternative the holder can be connected in one piece with the carrier shell and in this case the carrier shell forms the abutment. The carrier shell then engages on the underside of the insulator. Starting from the insulator, the holder can extend from the carrier shell to the sensor, which can e.g. project through a recess or receptacle in the vicinity of the upper portion of the holder.

One possibility for connecting the holder to a metal carrier shell is the welding or riveting of corresponding components. Preferably the holder is joined to or worked out from the carrier shell in one piece. This makes it possible to rough-work an elongated sheet metal strip separated by three notches, which form a U, from the carrier shell and bend or set up the same. The insulator can be engaged over the holder or at least one leg thereof. In particular during the fitting of the radiant heater, the holder can automatically pierce the insulator, at least partly project over the same and receive the sensor. Either the holder can pass through the insulator on engaging the latter or can project through a prefabricated slot in the insulator.

The invention also covers a radiant heater according to the preamble of claim 1, in which part of the fastening means is anchored in an abutment which is at least separate from the insulator, the abutment being located behind the underside of the insulator remote from the heater without projecting over the underside of the carrier shell remote from the insulator.

This makes it possible with radiant heaters having planar carrier shells to easily and advantageously stack the same, because the underside or the carrier shell is not projected over by interfering abutments or the like. In certain circumstances it is advantageously possible to economize the costs involved in providing the carrier shell from below with a recess for receiving the abutment.

Preferably the abutment is constructed separately from the carrier shell and can be anchored between the insulator and said shell.

One possibility for manufacturing the abutment involves the use of a firm, insulating material, e.g. vermiculite or the like. In it can be engaged at least one leg of the fastening means. A counterabutment is advantageously shaped like a disk and in particular with a large contact surface against the underside of the insulator. Further possibilities are truncated cones or cylinders.

These and further features can be gathered from the claims, description and drawings and the individual features, both individually and in the form of subcombinations, can be implemented in an embodiment of the invention and in other fields and can represent advantageous, independently protectable constructions for which protection is claimed here. The subdivision of the application into individual segments and the subheadings in no way restrict the general validity of the statements made thereunder.

BRIEF DESCRIPTION OF THE DRAWINGS

Embodiments of the invention are described hereinafter relative to the attached drawings, wherein show.

DETAILED DESCRIPTION OF THE EMBODIMENTS

Figure 1:
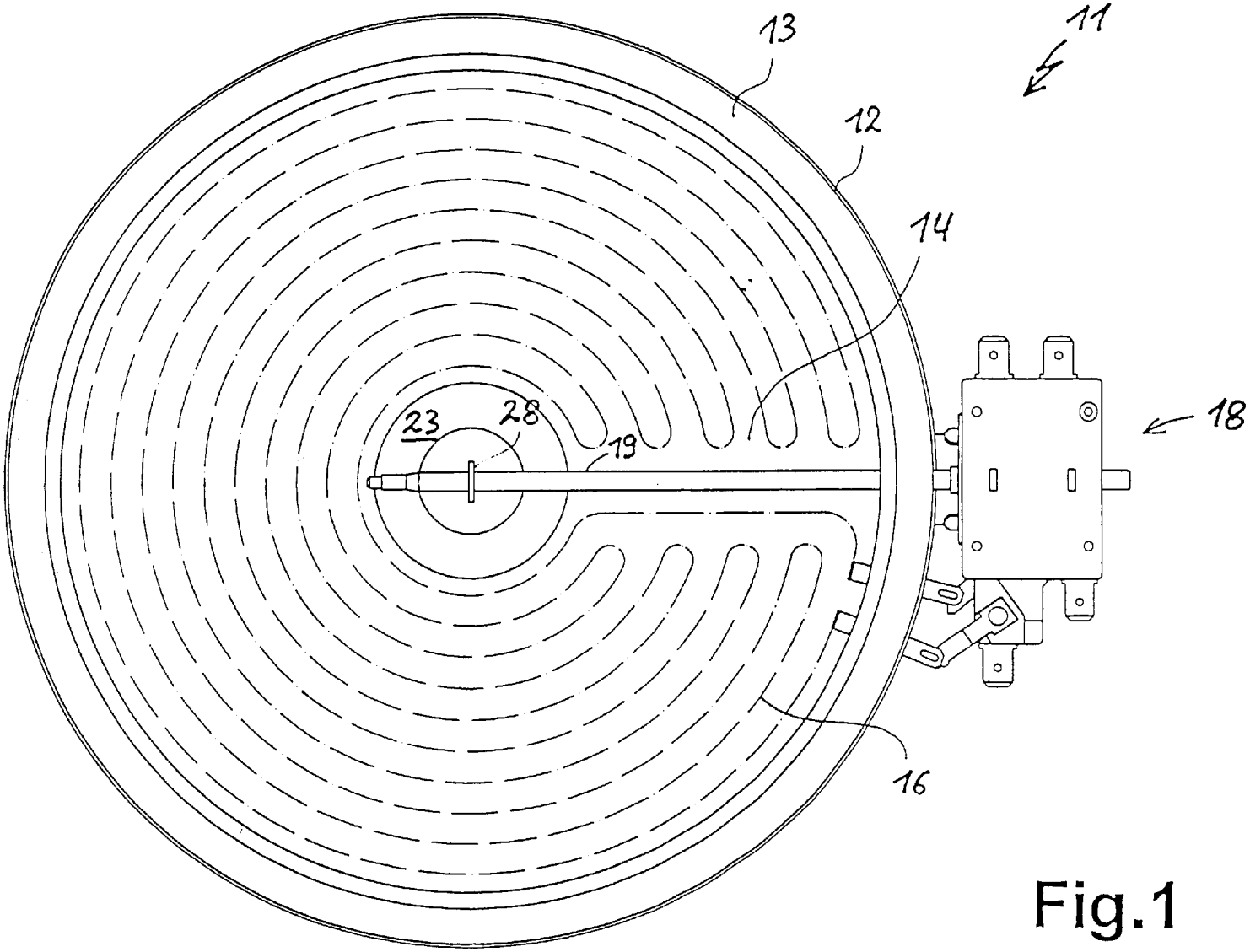
FIG. 1 A plan view of a radiant heater with a sensor fastening according to the invention.

FIG. 1 shows in plan view a radiant heater 11 in which an insulating border 13 and a flat insulator 14 are inserted in a carrier shell 12. The insulator 14 covering the bottom of the carrier shell 12 carries a heating means 16 comprising an elongated, meandering heating band or the like. The heating means 16 is electrically connected by means of a terminal or a thermal relay 18, which switches off the radiant heater 11 or heating means 16 in the case of an excessive temperature. For this purpose the thermal relay 18 has an elongated sensor 19 extending into the radiant heater 11 and which in known manner is made from materials having different thermal expansion coefficients and in particular one in rod-like form and the other surrounding it in tubular manner. The sensor 19 covers part of the heating zone formed by the heating means 16 and which essentially takes up the surface or area of the insulator 14. The sensor 19 extends by a portion over the centre of the radiant heater 11 and is fastened by a clip 28 to the insulator 14 or an elevation 23 thereof. A precise fixing of the position of the sensor is also considered advantageous for the operation thereof.

Figure 2:
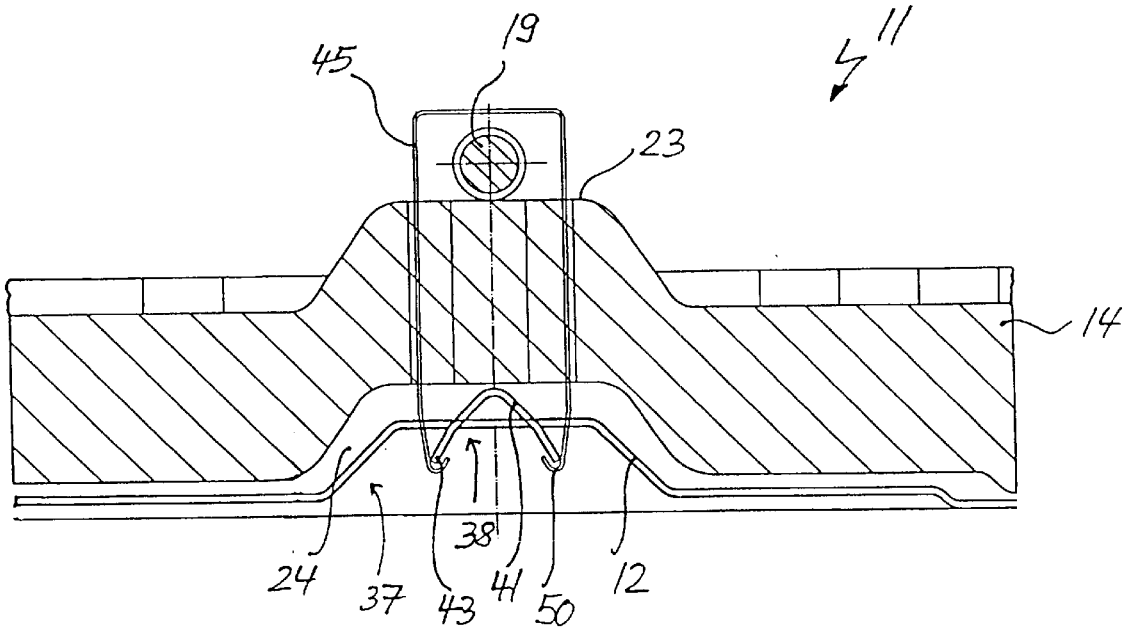
FIG. 2 A section through a radiant heater, the sensor being fastened by a clip to an abutment connected in one piece with the carrier shell.
Figure 3:
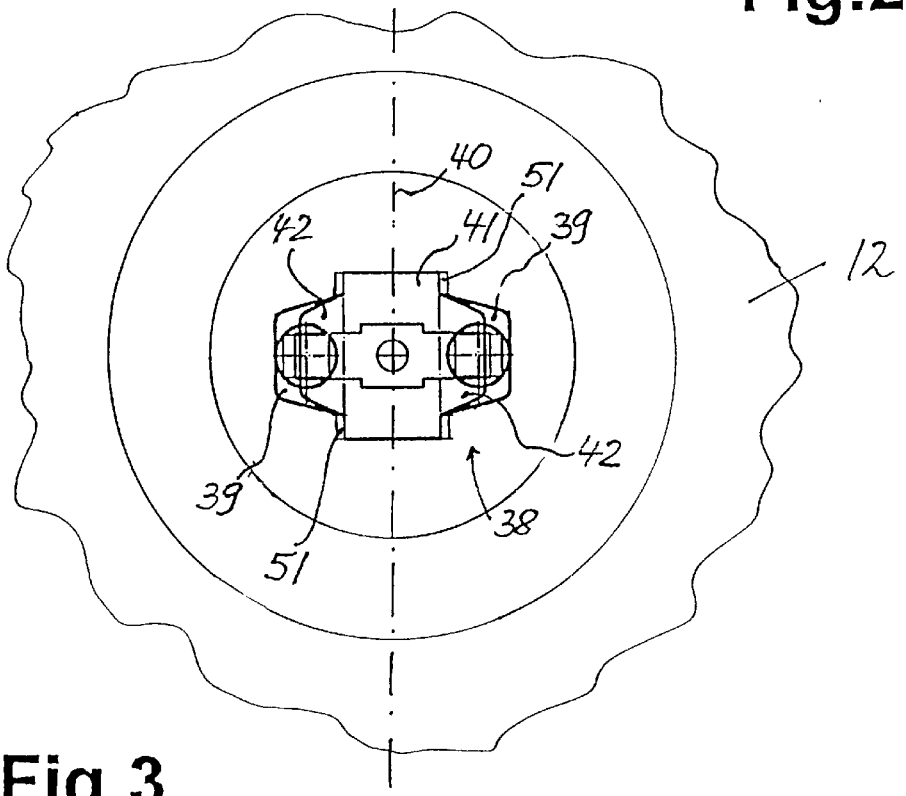
FIG. 3 A larger scale plan view of the abutment of FIG. 2.

FIG. 2 shows in section the arrangement of the sensor 19 on the insulator 14, together with the fastening thereof. In cross-section it is possible to see an elevation 23 in the central area of the insulator 14 and on which rests the sensor 19. Below the elevation 23 is provided a space 24, which is roughly frustum-shaped, in much the same way as the elevation 23. Below the insulator 14 is located the carrier shell 12, which carriers the insulator 14. The bulge 37 of the carrier shell 12 projects into the space 24 on the underside of the insulator 14. On the top of said bulge 23 an abutment 38 is shaped in one piece out of the carrier shell 12. For producing the abutment 38, two substantially U-shaped notches 39 are punched in the carrier shell 12 (FIG. 3). Firstly the cap-shaped central part 41 is shaped. The downwardly moving punch of a punching tool (not shown) separates or cuts out the width of the central part and, in much the same way as with a chisel, sets up during the further introduction of the central part 41. In the next step lug-like legs 42 are cut out in the opposite direction and set up or erected. The notches 39 are mirror symmetrical to a central axis 40 through the abutment 38. Four narrow connecting webs 51 by means of which the abutment 38, particularly its central part 41, is connected to the carrier shell 12 are not punched out. During the bending process the material of the carrier shell 12, particularly the metal sheet, is stretched, so that the two notches 39 retain the same mutual spacing. The ends of the two legs 42 form locking edges 43 into which can be locked the barb-like ends 50 of the holder 45. The central part 41 is wider than the two legs 42. It mainly serves as a bearing surface on the underside of the insulator 14. The cap-shaped cross-section of the abutment 38 creates an insertion bevel for inserting the two holder legs.

For fastening the holder 45, the latter is initially introduced by means of two holes, which are formed in the insulator 14, through said insulator 14 until its terminally inwardly bent barb-like ends 50 meet the two insertion bevels of the abutment. the holder 45 is widened by the insertion bevels widening in the insertion direction until it has reached the two locking edges 43 on the ends of the two abutment legs. The two barb-like ends 50 of the holder 45 engage below the locking edges 43 and snap into the latter.

Figure 4:
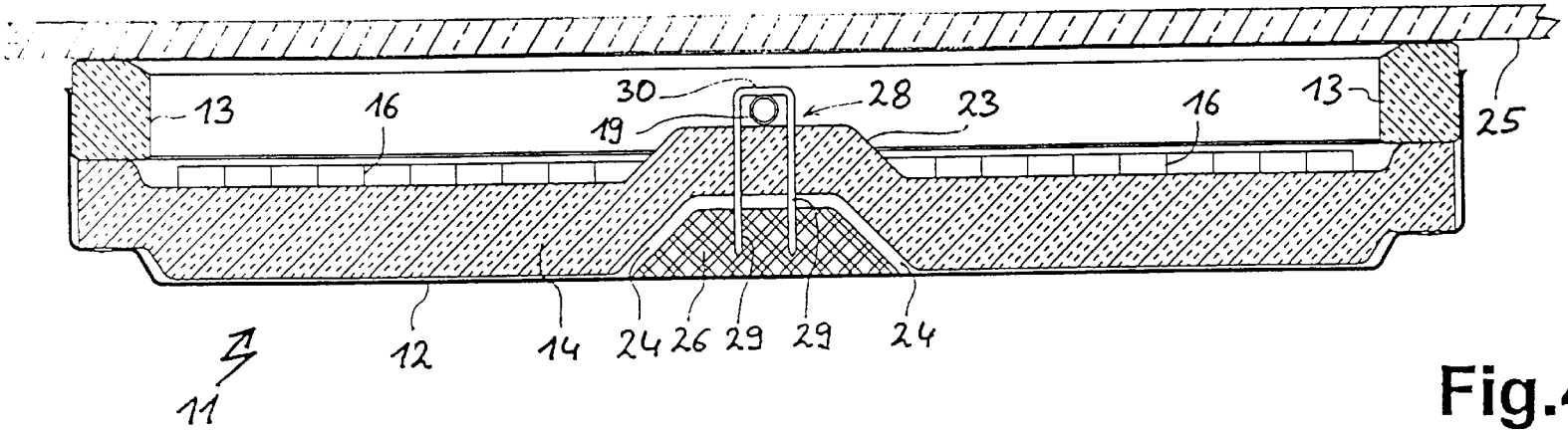
FIG. 4 A section through a variant of the radiant heater under a glass ceramic plate, the sensor being fastened by a clip to an insulating piece as the abutment.

FIG. 4 shows in section the structure of a variant of the radial heater 11, where it is possible to see the glass ceramic plate 25 above the insulator 14. In the space 24 between the insulator 14 and the carrier shell 12 is placed a frustum-shaped abutment 26, which roughly has the dimensions of the space 24. In the embodiment shown the abutment 26 is made from a preferably compacted insulating material, e.g. vermiculite or some other firm insulating material used in the electric heating field.

Over the sensor 19 is guided a U-shaped clip 28, whose two elongated legs 29 penetrate the insulator 14 and engage in the abutment 26. The base portion 30 between the two legs 29 engages over the sensor 19 and presses it against the insulator 14 or the top of the elevation 23. In this way the sensor 19 is virtually nailed against the abutment 26 by the clip 28 and is in this way fastened to the abutment or pressed against the insulator 14. An upward movement of the sensor 19 is prevented by the clip 28, which is not firmly retained in the insulator 14 and does not tear it or locally destroy it and instead engages with the much larger surface of the top of the abutment 26 on the underside of the elevation 23 of insulator 14. The legs 29 of clip 28 can have a roughed surface or tip for better anchoring purposes, e.g. in the manner of small barbs or the like. In place of a two-legged clip 28, it would also be possible to use a single bent nail or the like, e.g. an angle nail. However, the two legs reliably engage over the sensor 19 and the latter is thereby anchored with twice the retaining strength in the abutment 26. It is possible to fasten the abutment 26 to the carrier shell 12.

Figure 5:
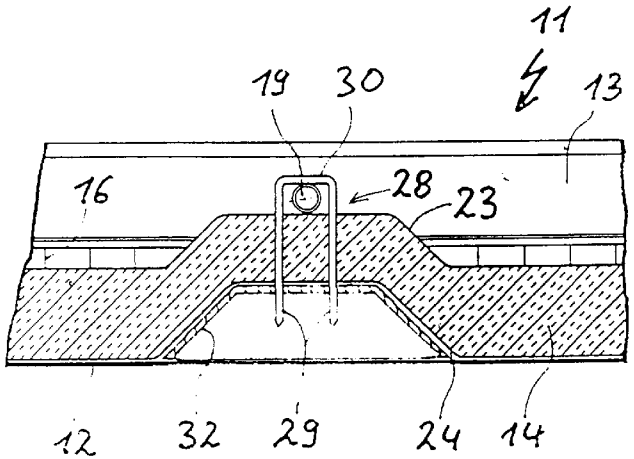
FIG. 5 A variant of the radiant heater according to FIG. 4, in which the abutment is a sheet metal part.

FIG. 5 shows a variant of a radiant heater 11 similar to FIG. 4, but in which the abutment 32 is made from a frustum-shaped flat material, e.g. thin sheet metal. The two legs 29 of the clip 28 a re securely anchored therein. Alternatively the clip 28 can be nailed into the carrier shell 12 in a direct manner without an abutment.

It is admittedly adequate e to construct the abutment merely in the form of a disk and not as a frustum, because the surface engaging on the underside of the elevation 23 of insulator 14 contributes to the loadability of the sensor fastening. However, the frustum-shaped construction of the abutment 32 has the advantage that when constructing the radiant heater 11 by placing on one another the individual parts the top of the abutment 32 extends to or just in front of the underside of the elevation 23. As a result for nailing the clip 28 there is no need to additionally counterhold the abutment and it is instead supported on the carrier shell 12.

FIG. 6 again shows a variant of the sensor fastening in which from the carrier shell 12 is separated and substantially vertically upwardly bent a strip-like sheet metal portion on both longitudinal sides and one end side. This leg-like fastening strip 31 projecting upwards from the carrier shell 12 extends through the insulator 14 or elevation 23 and projects over the latter. Into a recess 35 is introduced the sensor 19 and is pressed against the top of the elevation 23 and is prevented from an upward movement. As shown, the recess 35 can run roughly parallel to the plane of the heating means 16 or preferably rises slightly to the border, so that the sensor 19 cannot of its own accord slide out of it. It is also possible to bend over the upper end 36 of the fastening strip 34 for fixing the sensor 19. As the fastening strip 34, corresponding to the carrier shell 12, is made from a relatively thin metal sheet and as a result of separating or cutting therefrom has relatively sharp edges, on placing the insulator 14 on the carrier shell 12 it can penetrate the same without great effort. This is aided by a construction of the end in pointed manner.

Figure 6:
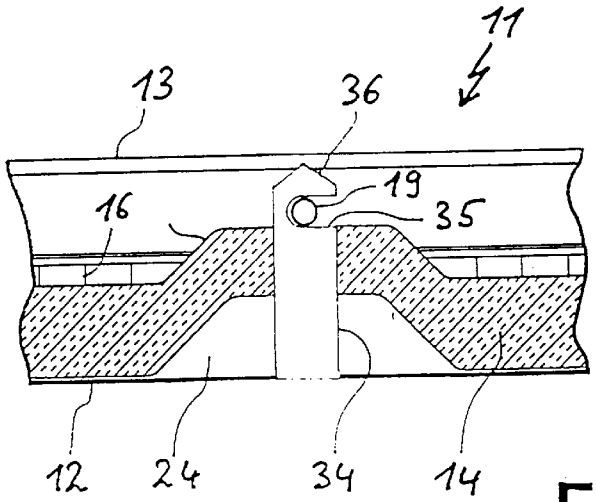
FIG. 6 Another variant in which a sheet metal leg is bent upwards out of the carrier shell and extends through the insulator.
Figure 7:
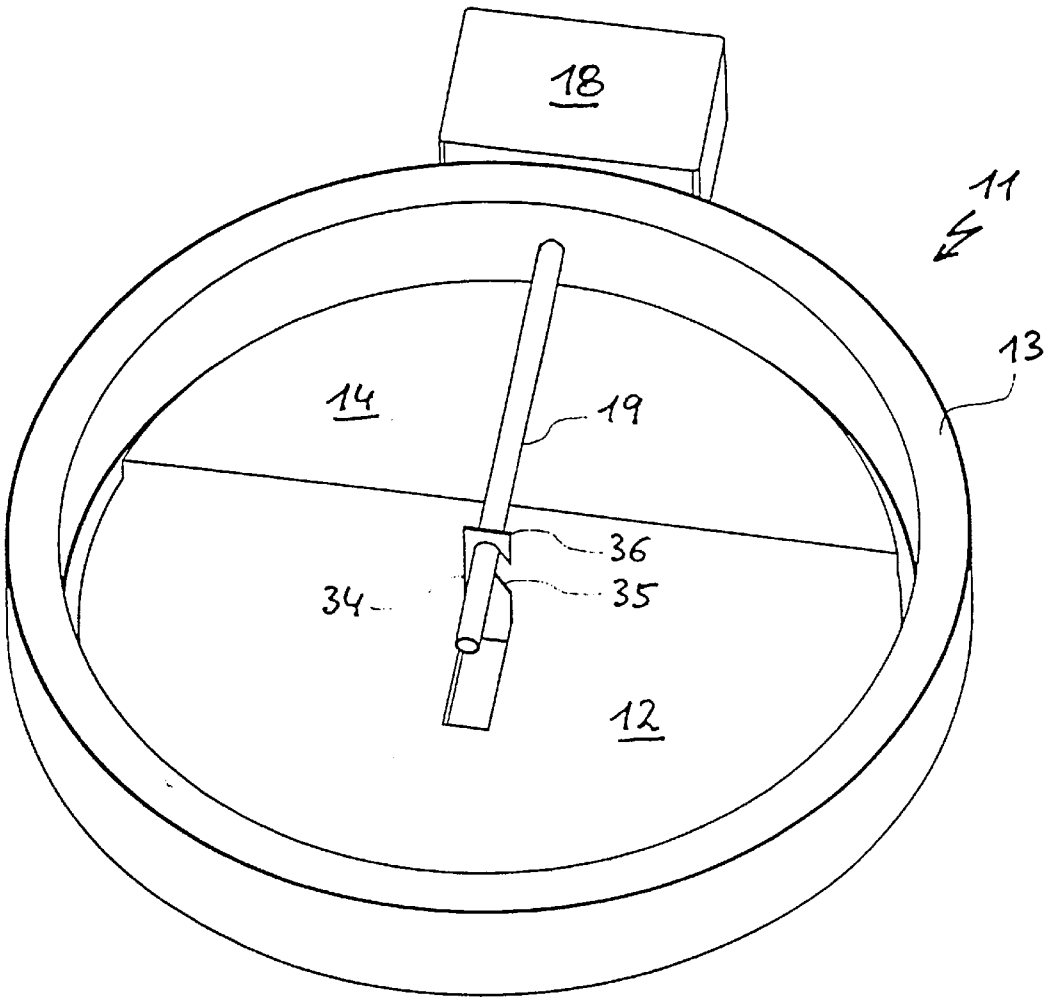
FIG. 7 An inclined view of a radiant heater showing the erected sheet metal strip of the carrier shell.

A perspective view of the radiant heater 11 similar to FIG. 6 is shown in FIG. 7. The insulator 14 is now shown in the rear part of the carrier shell 12. It is easy to see how the fastening strip 34 is on three sides punched or cut out of the bottom of the carrier shell 12 and bent upwards. In the recess 35 located at its end and which is inclined in the aforementioned manner, is introduced the sensor 19 and consequently through the upper end 36 is prevented from sliding out and from moving upwards. The recess 35 can be constructed in such a way that in the marginal area it is at least partly located within the insulator 14. Thus, on introducing the sensor 19 the insulator must be slightly displaced or pressed downwards with the advantage that it expands again after introduction and virtually closes the recess. Through a fastening according to FIGS. 6 and 7 the sensor 19 can be positioned engaging not only directly against the insulator 14 or its elevation 23, but also at a random height between the top of the insulator 14 and the underside of the glass ceramic plate 25. This is also possible by a clip with a fixed ring or the like engaging round the sensor.

In place of a fastening strip 34 cut out from the carrier shell 12 and set up, it is possible to fit the same or a similar fastening element to the carrier shell, e.g. by welding.

The work effort for a fastening strip, particularly the cutting out according to FIGS. 6 and 7, is relatively limited and permits, without additional components, a reliable sensor fastening. A major additional advantage can be brought about in that the sensor fastening or the fastening means form a holding down means for the insulator 14 in the radiant heater 11, particularly against the carrier shell 12. If the pushing through the insulator 14 by the fastening strip 34 gives rise to problems, it is possible to prefabricate a through slot in the insulator 14. The advantage of an insulator as the abutment 26 is inter alia that it does not lead to heat conduction via clip 28 into space 24 or to the carrier shell 12.

In order to reduce any heat conduction problems between the heating zone and the carrier shell 12 or the space located below it, it is possible to provide the fastening strip 34 with transversely directed notches or the like, in order to reduce its thermal conductivity. If an electrical insulation is desired or required between the sensor 19 and carrier shell 12, prior to the introduction of the sensor 19 into the recess 13, an insulating tube, e.g. of ceramic material, can be placed over the sensor.

What is claimed is:

1. Radiant heater for placing under a cooking area, with a carrier shell carrying an insulator, comprising:

heating means forming a heating zone located on said insulator, and a protective switch having an elongated temperature sensor;

said elongated temperature sensor extending over at least part of said heating zone and being located between said heating zone and said cooking area;

said elongated temperature sensor being retained by fastening means extending through said insulator and said carrier shell;

wherein said fastening means are at least partly shaped from the material of said carrier shell;

wherein said fastening means are formed by a holder for holding said sensor and an abutment for securing said holder; and wherein said holder is secured to said abutment by an automatic locking connection.

2. Radiant heater according to claim 1, wherein said abutment is formed from said carrier shell by two substantially U-shaped notches.

3. Radiant heater according to claim 1, wherein said abutment has an insertion bevel for inserting said holder and a locking edge for locking a barb-like end of said holder.

4. Radiant heater according to claim 1, wherein said abutment has a substantially cap-shaped cross-section, a central portion of said abutment being arcuately directed towards said insulator and two lug-like legs of said abutment are bent away from said insulator.

5. Radiant heater according to claim 1, wherein said abutment is connected to said carrier shell by four connecting webs left behind during the formation of said notches.

6. Radiant heater according to claim 5, wherein a central portion of said abutment is connected to said carrier shell.

7. Radiant heater according to claim 1, wherein said abutment is formed in a bulge of said carrier shell directed towards said insulator, said bulge of said carrier shell projecting into a bulge on said insulator constructed in complimentary manner thereto.

8. Radiant heater according to claim 1, wherein said holder has at least one long holding leg extending through said insulator to said abutment.

9. Radiant heater according to claim 8, wherein said long holding leg at least partly engages over said sensor.

10. Radiant heater according to claim 8, wherein said holder is a clip with two holding legs, extending to or engaging over said sensor with a substantially U-shaped upper part.

11. Radiant heater according to claim 8, wherein said holder is connected in one piece to said carrier shell and projects through said insulator to said sensor.

12. Radiant heater according to claim 11, wherein said holder has at least one portion partly separated by notches from said carrier shell and bent down.

13. Radiant heater according to claim 8, wherein said insulator can be placed over said holder, said fastening means automatically piercing and projecting beyond said insulator.

14. Radiant heater for placing under a cooking area, with a carrier shell carrying an insulator, comprising:

heating means forming a heating zone located on said insulator, and a protective switch having an elongated temperature sensor;

said elongated temperature sensor extending over at least part of said heating zone and being located between said heating zone and said cooking area;

said elongated temperature sensor being retained by fastening means extending through said insulator and said carrier shell;

wherein said fastening means are at least partly shaped from the material of said carrier shell;

wherein said fastening means are formed by a holder for holding said sensor and an abutment for securing said holder; and wherein said abutment has an insertion bevel for inserting said holder and a locking edge for locking a barb-like end of said holder.

15. Radiant heater according to claim 14, wherein said holder is secured to said abutment by an automatic locking connection.

16. Radiant heater according to claim 15, wherein said abutment is formed from said carrier shell by two substantially U-shaped notches.

17. Radiant heater according to claim 14, wherein said abutment has a substantially cap-shaped cross-section, a central portion of said abutment being arcuately directed towards said insulator and two lug-like legs of said abutment are bent away from said insulator.

18. Radiant heater according to claim 16, wherein said abutment is connected to said carrier shell by four connecting webs left behind during the formation of said notches.

19. Radiant heater according to claim 18, wherein a central portion of said abutment is connected to said carrier shell.

20. Radiant heater according to claim 14, wherein said abutment is formed in a bulge of said carrier shell directed towards said insulator, said bulge of said carrier shell projecting into a bulge on said insulator constructed in complimentary manner thereto.

21. Radiant heater according to claim 14, wherein said holder has at least one long holding leg extending through said insulator to said abutment.

22. Radiant heater according to claim 17, wherein said long holding leg at least partly engages over said sensor.

23. Radiant heater according to claim 17, wherein said holder is a clip with two holding legs, extending to or engaging over said sensor with a substantially U-shaped upper part.

24. Radiant heater for placing under a cooking area, with a carrier shell carrying an insulator, comprising:

heating means forming a heating zone located on said insulator, and a protective switch having an elongated temperature sensor;

said elongated temperature sensor extending over at least part of said heating zone and being located between said heating zone and said cooking area;

said elongated temperature sensor being retained by fastening means extending through said insulator and said carrier shell;

wherein said fastening means are at least partly shaped from the material of said carrier shell;

wherein said fastening means are formed by a holder for holding said sensor and an abutment for securing said holder;

wherein said abutment has a substantially cap-shaped cross-section; and wherein a central portion of said abutment is arcuately directed towards said insulator and two lug-like legs of said abutment are bent away from said insulator.

25. Radiant heater according to claim 24, wherein said holder is secured to said abutment by an automatic locking connection.

26. Radiant heater according to claim 25, wherein said abutment is formed from said carrier shell by two substantially U-shaped notches.

27. Radiant heater according to claim 24, wherein said abutment has an insertion bevel for inserting said holder and a locking edge for locking a barb-like end of said holder.

28. Radiant heater according to claim 26, wherein said abutment is connected to said carrier shell by four connecting webs left behind during the formation of said notches.

29. Radiant heater according to claim 28, wherein a central portion of said abutment is connected to said carrier shell.

30. Radiant heater according to claim 24, wherein said abutment is formed in a bulge of said carrier shell directed towards said insulator, said bulge of said carrier shell projecting into a bulge on said insulator constructed in complimentary manner thereto.

31. Radiant heater according to claim 24, wherein said holder has at least one long holding leg extending through said insulator to said abutment.

32. Radiant heater according to claim 31, wherein said long holding leg at least partly engages over said sensor.

33. Radiant heater according to claim 31, wherein said holder is a clip with two holding legs, extending to or engaging over said sensor with a substantially U-shaped upper part.

34. Radiant heater for placing under a cooking area, with a carrier shell carrying an insulator, comprising:

heating means forming a heating zone located on said insulator, and a protective switch having an elongated temperature sensor;

said elongated temperature sensor extending over at least part of said heating zone and being located between said heating zone and said cooking area;

said elongated temperature sensor being retained by fastening means extending through said insulator and said carrier shell;

wherein said fastening means are at least partly shaped from the material of said carrier shell;

wherein said fastening means are formed by a holder for holding said sensor and an abutment for securing said holder;

wherein said abutment is formed in a bulge of said carrier shell directed towards said insulator; and wherein said bulge of said carrier shell projects into a bulge on said insulator constructed in a complimentary manner thereto.

35. Radiant heater according to claim 34, wherein said holder is secured to said abutment by an automatic locking connection.

36. Radiant heater according to claim 35, wherein said abutment is formed from said carrier shell by two substantially U-shaped notches.

37. Radiant heater according to claim 34, wherein said abutment has an insertion bevel for inserting said holder and a locking edge for locking a barb-like end of said holder.

38. Radiant heater according to claim 34, wherein said abutment has a substantially cap-shaped cross-section, a central portion of said abutment being arcuately directed towards said insulator and two lug-like legs of said abutment are bent away from said insulator.

39. Radiant heater according to claim 36, wherein said abutment is connected to said carrier shell by four connecting webs left behind during the formation of said notches.

40. Radiant heater according to claim 39, wherein a central portion of said abutment is connected to said carrier shell.

41. Radiant heater according to claim 34, wherein said holder has at least one long holding leg extending through said insulator to said abutment.

42. Radiant heater according to claim 41, wherein said long holding leg at least partly engages over said sensor.

43. Radiant heater according to claim 41, wherein said holder is a clip with two holding legs, extending to or engaging over said sensor with a substantially U-shaped upper part.

* * * * *

UNITED STATES PATENT AND TRADEMARK OFFICE

CERTIFICATE OF CORRECTION

PATENT NO. : 6,483,084 B2
DATED : November 19, 2002
INVENTOR(S) : Heinz Petri et al.

It is certified that error appears in the above-identified patent and that said Letters Patent is hereby corrected as shown below:

Column 7,
Line 12, replace "according to claim 1" with -- according claim 2 --

Signed and Sealed this

Seventh Day of October, 2003

JAMES E. ROGAN
*Director of the United States Patent and Trademark Office*